US010493759B2

(12) United States Patent
Matsumoto et al.

(10) Patent No.: US 10,493,759 B2
(45) Date of Patent: Dec. 3, 2019

(54) DEVICES FOR FOIL TRANSFER

(71) Applicant: Roland DG Corporation, Hamamatsu-shi, Shizuoka (JP)

(72) Inventors: Sho Matsumoto, Hamamatsu (JP); Fumihiro Takahashi, Mahamatsu (JP); Takeshi Tozuka, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/131,076

(22) Filed: Sep. 14, 2018

(65) Prior Publication Data

US 2019/0092010 A1 Mar. 28, 2019

(30) Foreign Application Priority Data

Sep. 22, 2017 (JP) ..... 2017-182503

(51) Int. Cl.

| | |
|---|---|
| ***B41M 5/46*** | (2006.01) |
| ***B41J 2/14*** | (2006.01) |
| ***B41J 2/44*** | (2006.01) |
| ***B41M 5/382*** | (2006.01) |
| *B41J 2/005* | (2006.01) |

(52) U.S. Cl.

CPC ..... *B41J 2/14104* (2013.01); *B41J 2/442* (2013.01); *B41M 5/382* (2013.01); *B41M 5/46* (2013.01); *B41J 2002/0052* (2013.01)

(58) Field of Classification Search

CPC ..... B41J 2/14104; B41J 2/442; B41M 5/382; B41M 5/46

See application file for complete search history.

(56) References Cited

U.S. PATENT DOCUMENTS

| | | | | |
|---|---|---|---|---|
| 9,972,516 | B2 * | 5/2018 | Miyagi | H01L 21/67225 |
| 2012/0242008 | A1 * | 9/2012 | Iwashima | H01L 31/022433 264/401 |
| 2016/0282725 | A1 * | 9/2016 | Miyagi | H01L 21/67225 |

FOREIGN PATENT DOCUMENTS

| | | | |
|---|---|---|---|
| JP | 5926083 | B2 | 5/2016 |
| JP | 2016-215599 | A | 12/2016 |

* cited by examiner

*Primary Examiner* — Lamson D Nguyen
(74) *Attorney, Agent, or Firm* — Keating & Bennett, LLP

(57) ABSTRACT

A foil transfer device includes a light emitter that emits light, a driver that causes scanning to be performed with the light by moving one or both of an irradiator and a substrate relative to each other, the irradiator casting the light emitted by the light emitter, and a controller that causes the light emitter to change power of the light according to a velocity indication value during at least one of an acceleration period from a time when at least one of the irradiator and the substrate begins to move to a time when a velocity thereof becomes constant and a deceleration period from a time when the velocity is constant to a time when at least one of the irradiator and the substrate stops.

3 Claims, 5 Drawing Sheets

DEVICES FOR FOIL TRANSFER

CROSS REFERENCE TO RELATED APPLICATIONS

This application claims the benefit of priority to Japanese Patent Application No. 2017-182503 filed on Sep. 22, 2017. The entire contents of this application are hereby incorporated herein by reference.

BACKGROUND OF THE INVENTION

1. Field of the Invention

The present invention relates to foil transfer devices.

2. Description of the Related Art

Conventionally, characters, patterns, and graphics are often printed onto a substrate such as paper or leather by transferring a foil film such as metallic foils and films with a pigmented coating to a surface of the substrate. Printing images such as characters with foil films can improve visibility and decorativeness.

Laser beams can be used as a means to transfer foil films to a substrate. For example, Japanese Patent No. 5926083 discloses a transfer method that includes a lapping step for lapping a composite of a transfer layer and an adhesive layer over the substrate, and a laser irradiation step for irradiating the composite with a laser beam to transfer the transfer layer to the substrate. Laser beams are casted by a laser irradiation unit. The laser irradiation unit is configured to be able to scan the composite using driving means and can irradiate a transfer image (transfer region) with a laser beam.

Here, an example is described where a straight line, with start point "S" and end point "E," is transferred to a substrate C by scanning, with a laser beam, the substrate C on which a foil film F is laid. In this conventional foil application methods, the laser beam is emitted by applying an electric current to a laser emitter. Then, an irradiation unit (for example, a laser irradiation unit in Japanese Patent No. 5926083) that casts the laser beam emitted by the laser emitter is linearly moved from the start point "S" to the end point "E" at a predetermined velocity. By adjusting the amount of electric current flowing through the laser emitter, the power of the laser beam can be varied.

FIG. 6 is a diagram showing transitions of a velocity indication value supplied to the irradiation unit and an electric current value flowing through the laser emitter used in a conventional foil application method. The velocity indication value is for moving the irradiation unit at a predetermined velocity or velocities. As can be seen in FIG. 6, the velocity indication value gradually increases during the acceleration of the irradiation unit and gradually decreases during the deceleration of the irradiation unit; therefore, the irradiation unit does not move at a constant velocity during acceleration and deceleration.

On the contrary, as can be seen in FIG. 6, the electric current value flowing through the laser emitter reaches a predetermined value immediately once the acceleration of the irradiation unit begins and drops to zero immediately as the irradiation unit stops; therefore, the power of the laser beam was constant throughout the entire movement of the irradiation unit.

Thus, in the conventional foil application methods, the power of the laser beam is constant despite the non-constant traveling velocities of the irradiation unit during acceleration or deceleration and the foil film F will experience more heat.

Since certain areas of the foil film F that are not intended to be transferred also receive the heat, the transferred area in the foil film F becomes expanded, causing uneven transfer of the foil film F (see FIG. 7).

Owing to this, foil transfer devices described in JP-A-2016-215599 control the laser beam so as not to irradiate the foil film with the laser beam during the acceleration and deceleration in scanning a light pen (corresponding to the aforementioned irradiation unit).

SUMMARY OF THE INVENTION

Preferred embodiments of the present invention provide foil transfer devices with each of which uneven transfer during acceleration and deceleration of an irradiator that casts light is able to be reduced.

A preferred embodiment of the present invention provides a foil transfer device to transfer a foil film to a substrate into a predetermined shape by scanning with light, the substrate on which the foil film is provided, the device including a light emitter that emits the light; a driver to perform the scanning with the light by moving one or both of an irradiator and the substrate relative to each other to cause the irradiator to cast the light emitted by the light emitter; and a controller that controls the light emitter so as to cause the light emitter to change power of the light according to a velocity indication value during at least one of an acceleration period from a time when at least one of the irradiator and the substrate begins to move to a time when a velocity thereof becomes constant and a deceleration period from a time when the velocity is constant to a time when at least one of the irradiator and the substrate stops.

Other features of preferred embodiments of the present invention will be apparent from the description of preferred embodiments in the specification.

According to preferred embodiments of the present invention, it is possible to reduce uneven transfer during the acceleration and deceleration of the irradiator that casts light.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Referring to FIGS. 1 to 4, a foil transfer device 1 according to a first preferred embodiment of the present invention is described.

Figure 1:
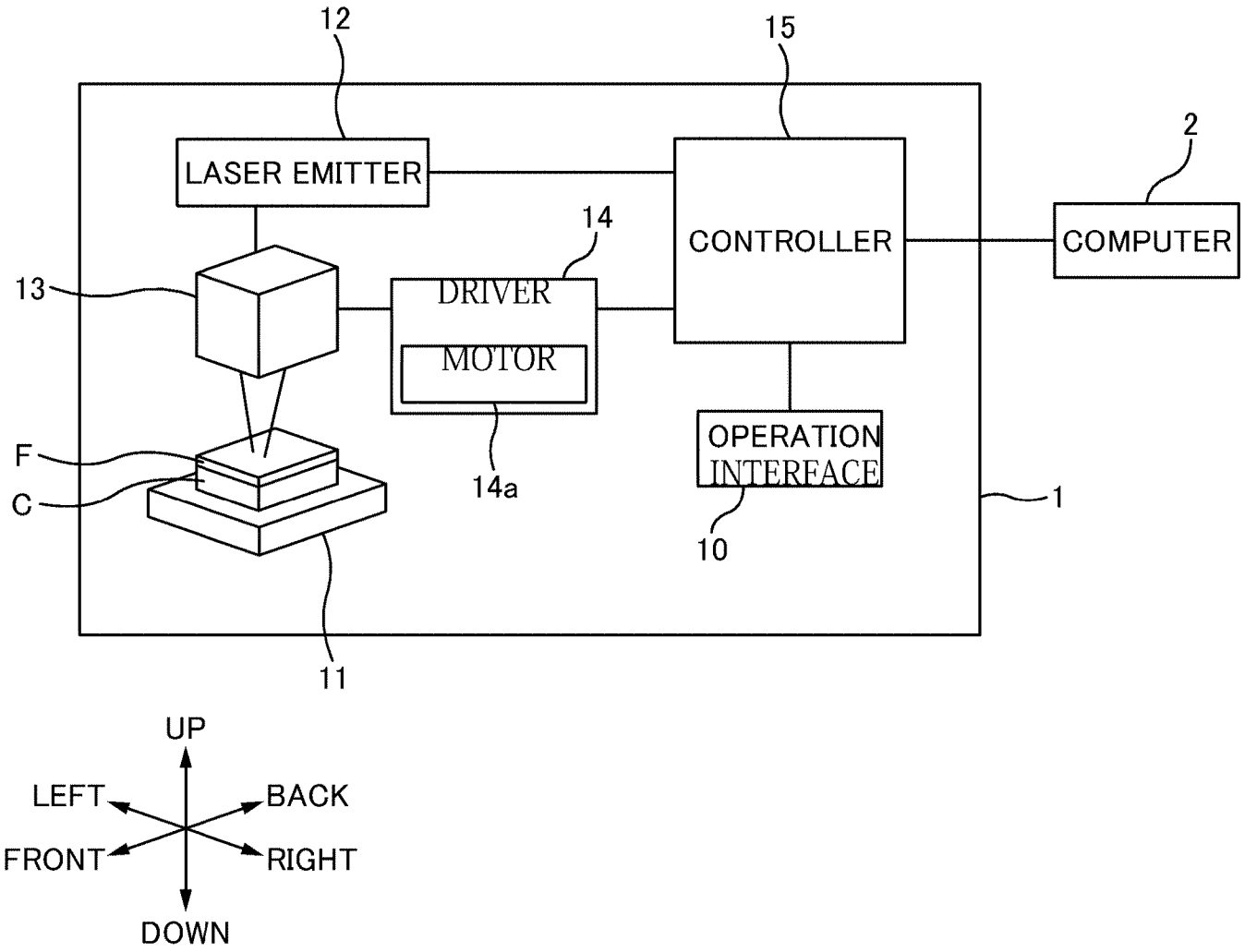
FIG. 1 is a schematic diagram showing a foil transfer device according to a first preferred embodiment of the present invention.

The foil transfer device 1 according to this preferred embodiment transfers a foil film F to a substrate C into a predetermined shape by scanning, with a laser beam, the substrate C on which the foil film F is laid. As shown in FIG. 1, the foil transfer device 1 includes an operation interface 10, a table 11, a laser emitter 12, an irradiator 13, a driver 14, and a controller 15. The foil transfer device 1 is connected to an external computer 2 such that they can communicate with each other. The foil transfer device 1 may be realized partially or completely by the functioning of the computer 2.

The computer 2 generates data about scanning paths along a predetermined shape (such as a contour of a character) to be transferred to the substrate C and transmits the data to the foil transfer device 1. A personal computer may be used as the computer 2. A processing operation to create the scanning path is performed using a predetermined program installed on the computer 2 beforehand.

The operation interface 10 enables a user to enter various inputs to the foil transfer device 1. The operation interface 10 may be a user interface including a device such as a display on which results of processing by the foil transfer device 1 are displayed. Further, the computer 2 may define and function as the operation interface 10.

The table 11 supports the substrate C placed thereon. The table 11 according to this preferred embodiment is secured to the main body of the foil transfer device 1. The surface (i.e., the transfer surface) of the substrate C on which an object such as a character is to be transferred is covered with the foil film F. An adhesive layer may be provided between the foil film F and the substrate C.

The laser emitter 12 emits a laser beam. For the laser emitter 12, a semiconductor laser with a wavelength of 450 nm and maximum power of 1 W, for example, can be used. The laser emitter 12 is not limited to a semiconductor laser and a solid-state laser or a gas-state laser may also be used. By applying a predetermined electric current to the laser emitter 12, a laser beam is emitted from the laser emitter 12. By adjusting the electric current flowing through the laser emitter 12, power of the laser beam is able to be controlled (details are described later). The laser emitter 12 according to this preferred embodiment is an example of the "light emitter."

The irradiator 13 casts the laser beam emitted by the laser emitter 12. The irradiator 13 is movable in three directions perpendicular to each other (i.e., back and forth, side to side, and vertical).

Figure 2:
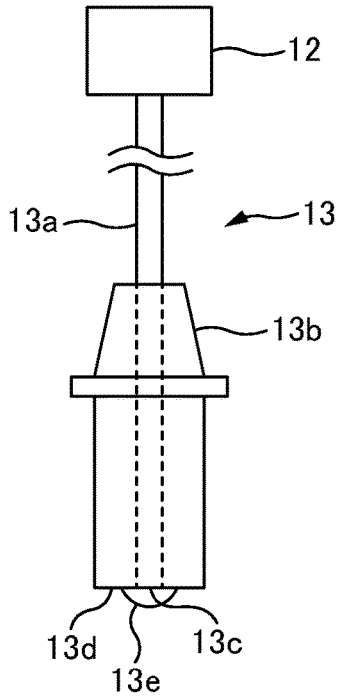
FIG. 2 is a schematic diagram showing an irradiator according to the first preferred embodiment of the present invention.

The irradiator 13 according to this preferred embodiment includes an optical fiber 13*a* and a housing 13*b* (see FIG. 2). The optical fiber 13*a* is connected to the laser emitter 12 and transmits the laser beam emitted by the laser emitter 12. The laser beam is emitted out of an output end 13*c* of the optical fiber 13*a*. The housing 13*b* is a thin, elongated structure in which the optical fiber 13*a* is held. The output end 13*c* of the optical fiber 13*a* is flush or substantially flush with a bottom surface 13*d* of the housing 13*b*. To the bottom surface 13*d*, a projection 13*e* is secured to cover the output end 13*c*. In this preferred embodiment, the projection 13*e* preferably has a hemispherical shape. The projection 13*e* is preferably made of a material that transmits a laser beam that comes out of the output end 13*c*. Transfer of the foil film F is performed by pressing the bottom surface 13*d* against the substrate C via the foil film F and casting the laser beam in that state. Further, in transferring a portion of the foil film F into a certain shape, the irradiator 13 is able to move and irradiate the substrate C with the laser beam while pressing the substrate C. The projection 13*e* facilitates the application of the pressure, and its hemispherical shape allows smooth motion of the irradiator 13 even while pressing the substrate C.

It should be noted that the irradiator 13 may be disposed directly on the main body of the foil transfer device 1 or indirectly via a carriage that is movable in three directions. The irradiator 13 may carry the laser emitter 12. Further, although the projection 13*e* in FIG. 2 has a hemispherical shape, it may have any shape as long as it protrudes from the bottom surface 13*d*. Further, in FIG. 2, the configuration in which the projection 13*e* covers the output end 13*c* has been described. However, the optical fiber 13*a* may pass through the projection 13*e* and the output end 13*c* may be flush or substantially flush with the bottom surface of the projection 13*e*.

The driver 14 causes performing of the scanning with the laser beam by moving one or both of the irradiator 13 and the substrate C placed on the table 11 relative to each other. In this preferred embodiment, since the table 11 is secured to the main body of the foil transfer device 1, the driver 14 causes the scanning to performed with the laser beam by moving the irradiator 13.

The driver 14 includes a motor 14*a*. The motor 14*a* may be, for example, a set of three motors that perform driving back and forth, side to side, and in vertical directions. The motors 14*a* may be the same or different in performance (e.g., electric current, torque, rotational speed). The driver 14 according to this preferred embodiment is able to move the irradiator 13 back and forth, side to side, and up and down relative to the substrate C placed on the table 11.

For example, the driver 14 moves the irradiator 13 to an irradiation start position at which the irradiation of the substrate C with the laser beam begins. Subsequently, the driver 14 moves the irradiator 13 downward and presses it against the substrate C. The driver 14 then performs the scanning with the laser beam by moving the irradiator 13. The relationship between the power of the laser beam and the traveling velocity of the irradiator 13 will be described later.

The controller 15 performs various controls of the foil transfer device 1. The controller 15 of this preferred embodiment is configured or programmed to control the driver 14 to move the irradiator 13 in a predetermined direction. The controller 15 supplies, to the drive mechanism 14, data about scanning paths sent from the computer 2 and a velocity indication value according to the data about scanning paths. The drive mechanism 14 moves the irradiator 13 at the velocity based on the velocity indication value along the path designated by the data about scanning paths.

The velocity indication value is used to determine the velocity at which the irradiator 13 is moved. The controller 15 enters a predetermined velocity indication value to the driver 14. Here, the velocity indication value is different among during the acceleration period, the deceleration period, and the period of travel at a constant velocity. The acceleration period is a length of time from a time when the irradiator 13 begins to move to a time when the velocity thereof becomes constant. The deceleration period is a length of time from the time when the velocity is constant to a time when the irradiator 13 comes to a stop. The period of travel at the constant velocity is a length of time during which the irradiator 13 moves at a predetermined velocity (fixed velocity).

The velocity indication value for the acceleration is set such that the velocity gradually increases during a certain period. The velocity indication value for the deceleration is set such that the velocity gradually decreases during a certain period. The velocity indication value for the period of travel at the constant velocity is set such that the velocity is kept constant during a certain period.

In addition, the controller 15 changes the power of the laser beam emitted from the laser emitter 12 by controlling the laser emitter 12. Specifically, the controller 15 controls the laser emitter 12 so as to change the power of the laser beam according to the velocity indication value, at least during the acceleration or deceleration of the irradiator 13.

Figure 3:
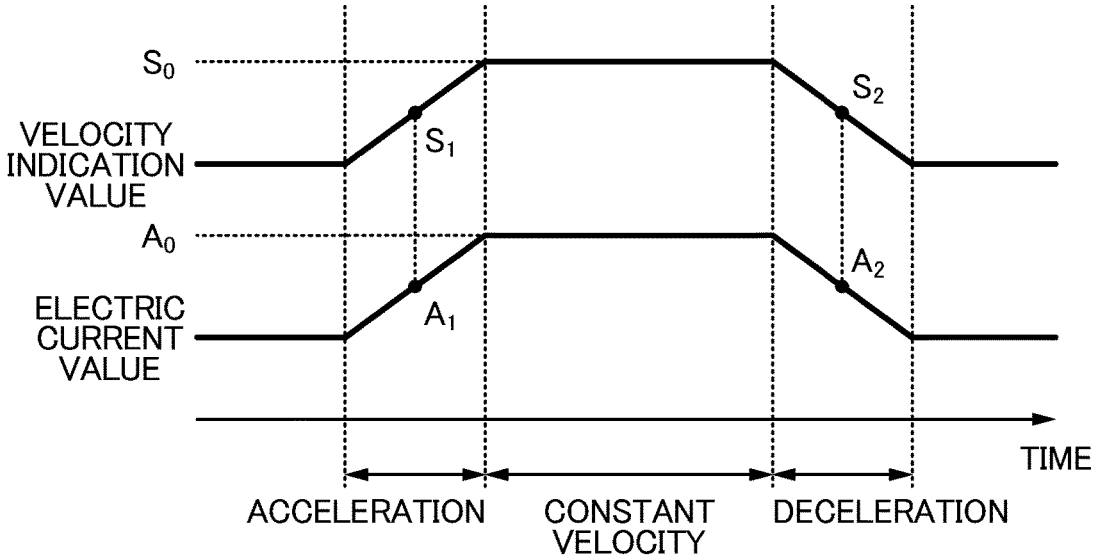
FIG. 3 is a diagram showing a relationship between a velocity indication value and an electric current value according to the first preferred embodiment of the present invention.

In this preferred embodiment, the controller 15 changes the power of the laser beam by analog control, for example. FIG. 3 is a diagram showing a relationship between the velocity indication value to determine the velocity at which the irradiator 13 is moved and an electric current value flowing through the laser emitter 12. The controller 15 moves the irradiator 13 by supplying the velocity indication value as shown in FIG. 3 to the driver 14 in time series. With the velocity indication value shown in FIG. 3, the irradiator 13 gradually accelerates according to the velocity indication value (the acceleration period) and, after reaching a certain velocity, moves at that velocity (the period of travel at the constant velocity). The irradiator 13 then gradually decelerates from the constant velocity (the deceleration period), and finally stops. It should be noted that predetermined values are set beforehand for the velocity at the constant velocity and the power of the laser beam (i.e., the electric current value) during the constant velocity.

The controller 15 changes the power of the laser beam by analog control according to such velocity indication value. Specifically, the controller 15 applies an analog voltage corresponding to the velocity indication value to the laser emitter 12. An electric current corresponding to the applied analog voltage flows through the laser emitter 12.

For example, as shown in FIG. 3, when the velocity indicated by a velocity indication value $S_1$ is about 50% of the constant velocity (i.e., the velocity indicated by a velocity indication value $S_0$) during acceleration, the controller 15 applies an analog voltage to the laser emitter 12 such that the electric current value becomes about 50% of a predetermined value $A_0$. An electric current (an electric current value $A_1$ that is equal to about 50% of the predetermined value $A_0$) according to the applied analog voltage flows through the laser emitter 12. Then, the controller 15 performs a control so that the electric current value becomes the predetermined value $A_0$ at the time point at which the mode switches from acceleration to constant velocity (i.e., the velocity indicated by a velocity indication value $S_0$).

On the other hand, as shown in FIG. 3, when the velocity indicated by a velocity indication value $S_2$ is about 50% of the constant velocity (i.e., the velocity indicated by a velocity indication value $S_0$) during deceleration, the controller 15 applies an analog voltage to the laser emitter 12 such that the electric current value becomes about 50% of the predetermined value $A_0$. An electric current (an electric current value $A_2$ that is equal to about 50% of the predetermined value $A_0$) according to the applied analog voltage flows through the laser emitter 12. Then, the controller 15 performs a control so that the electric current value becomes zero at the time point at which the velocity indication value becomes zero.

In other words, the controller 15 controls the electric current flowing through the laser emitter 12 so that it gradually increases during the acceleration and gradually decreases during the deceleration in a similar manner to the velocity indication value (see, the periods designated as "Acceleration" and "Deceleration" in FIG. 3). The velocity indication value is kept constant during the period of travel at the constant velocity; therefore, the controller 15 controls the electric current flowing through the laser emitter 12 to be fixed during the period of travel at the constant velocity (see the period designated as "Constant velocity" in FIG. 3).

By allowing the electric current to flow in the manner described above, the power of the laser beam gradually increases according to the traveling velocity of the irradiator 13 during the acceleration and the amount of heat transferred to the foil film F per unit time is made constant. Likewise, the power of the laser beam gradually decreases according to the traveling velocity of the irradiator 13 during the deceleration and the amount of heat transferred to the foil film F per unit time is also made constant. Therefore, the transferred foil film F never expands along the entire length of transfer between the start point S and the end point E (see FIG. 4). In other words, the controller 15 according to this preferred embodiment is able to provide analog control the laser output by analogously changing the electric current flowing according to the velocity indication value. Consequently, uneven transfer during acceleration and deceleration is reduced.

In the above preferred embodiment, the laser emitter 12 that emits the laser beam is used as the light emitter to transfer foil films, but the present invention is not limited thereto. For example, light emitting diodes can also be used as the light emitter. Further, any other elements other than light emitting diodes can also be used as the light emitter as long as they can change the power of the light by changing the electric current applied thereto.

While the above preferred embodiment describes an example where only the irradiator 13 moves, the present invention is not limited thereto. Specifically, foil films may be transferred by moving the table 11 back and forth, side to side, and in vertical directions relative to the fixed irradiator 13. In this case, the driver 14 drives the table 11 (for example, a motor moves the table 11 in three directions). Alternatively, both of the irradiator 13 and the table 11 may be moved.

As described above, the foil transfer device 1 according to this preferred embodiment transfers the foil film F to the substrate C into a predetermined shape by scanning, with light, the substrate C on which the foil film F is laid. The foil transfer device 1 includes a light emitter that emits the light; the driver 14 to cause the scanning to be performed with the light by moving one or both of the substrate C and the irradiator 13 that casts the light emitted by the light emitter relative to each other; and the controller 15 that controls the light emitter so as to allow the light emitter to change the power of the light according to the velocity indication value during at least one of the acceleration period from a time when at least one of the irradiator 13 and the substrate C begins to move to a time when a velocity thereof becomes constant and the deceleration period from a time when the velocity is constant to a time when at least one of the irradiator 13 and the substrate C stops. The controller 15 of this preferred embodiment controls the light emitter so as to allow the light emitter to change the power of the light by analog control.

According to such a configuration, during the acceleration and/or deceleration of the irradiator 13 and/or the substrate C, the power of the light is gradually adjusted according to the velocity. Therefore, the amount of heat transferred to the foil film F per unit time is made constant. That is, according to the foil transfer device 1 of this preferred embodiment, uneven transfer is able to be prevented even during acceleration or deceleration.

Second Preferred Embodiment

Figure 5A:
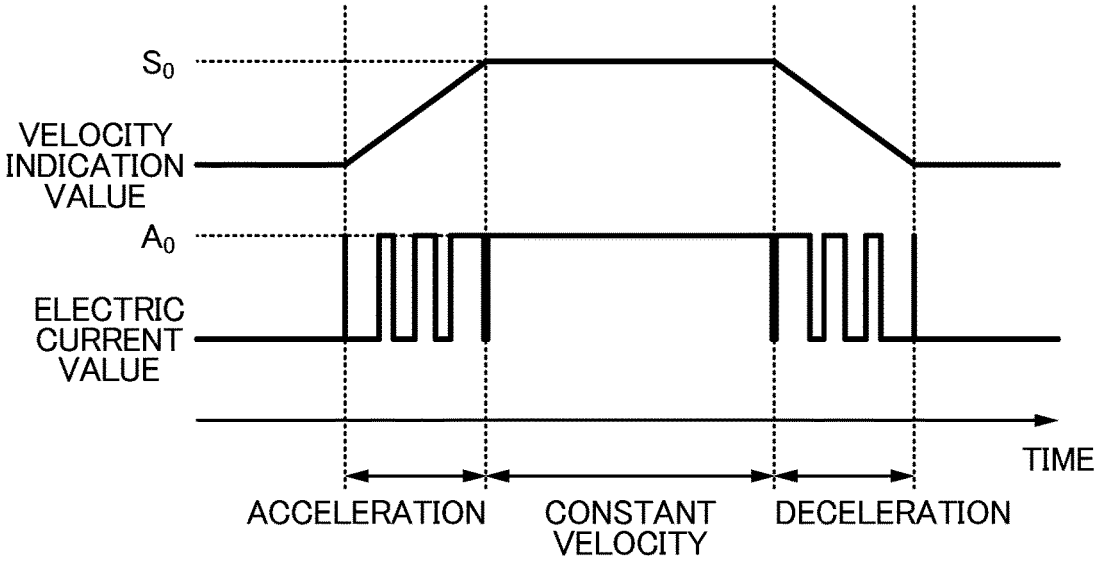
FIG. 5A is a diagram showing a relationship between a velocity indication value and an electric current value according to a second preferred embodiment of the present invention.
Figure 5B:
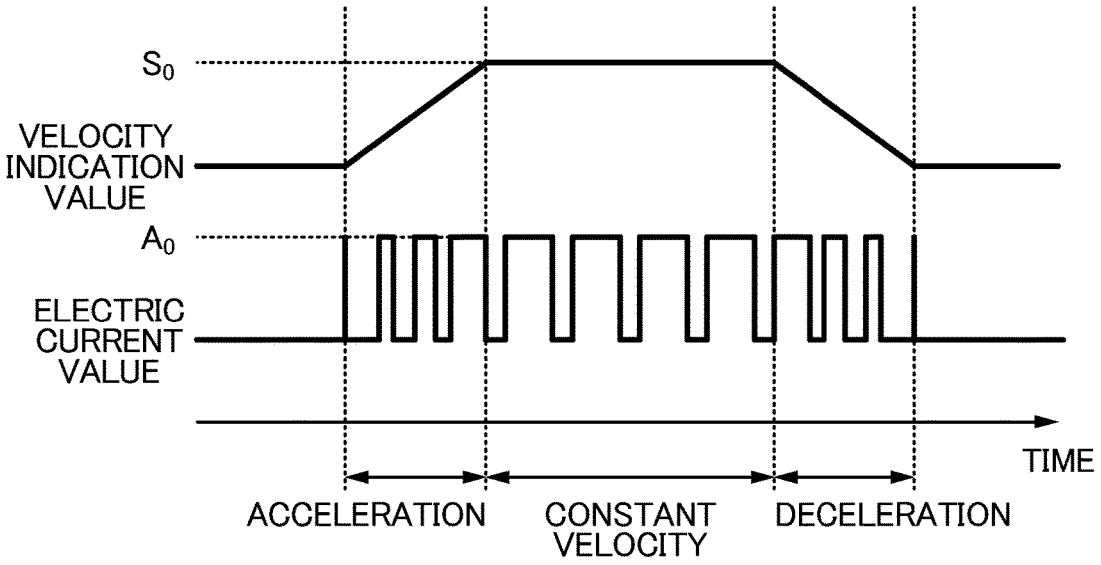
FIG. 5B is a diagram showing a relationship between the velocity indication value and the electric current value according to the second preferred embodiment of the present invention.
Figure 6:
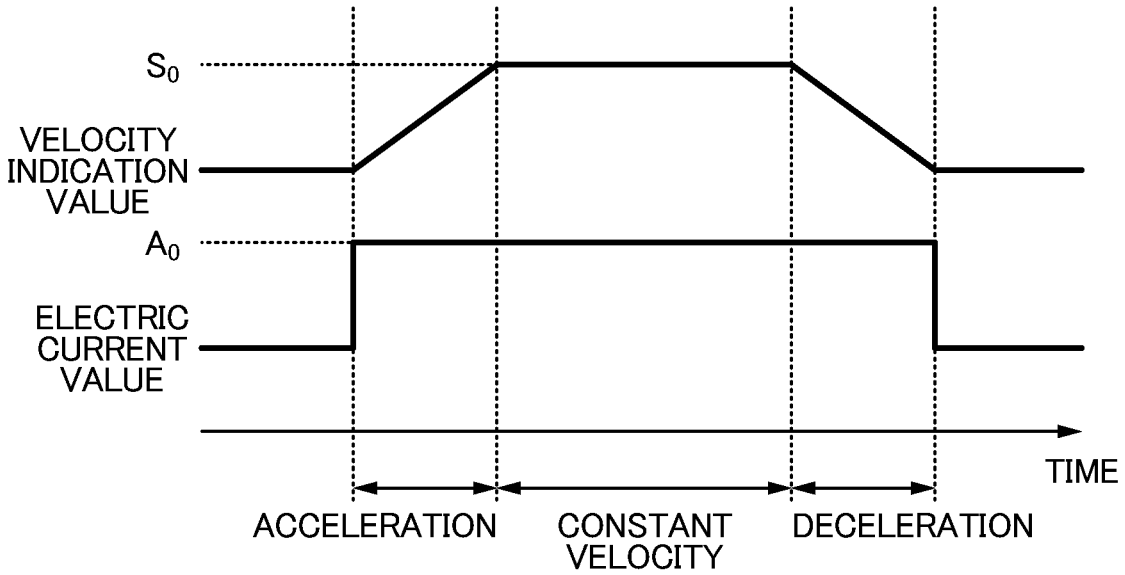
FIG. 6 Prior Art
FIG. 6 is a diagram showing a relationship between a velocity indication value and an electric current value according to a conventional art.

Next, referring to FIGS. 5A and 5B, a foil transfer device 1 according to the second preferred embodiment is described.

Some laser emitters such as semiconductor lasers have a function of not emitting a laser beam when the amount of applied electric current is smaller than a predetermined value (i.e., emitting a laser beam for the first time when a certain amount of electric current flows).

Thus, with the analog control of the power of the laser beam during acceleration and/or deceleration of the irradiator 13 as in the case of the first preferred embodiment, it is possible that a laser beam is not emitted at the time when acceleration of the irradiator 13 begins or at the time immediately before it comes to a stop. In other words, it is possible that the power of the laser beam required to transfer foil films cannot be obtained at the beginning of the acceleration or just before the stop.

Figure 4:
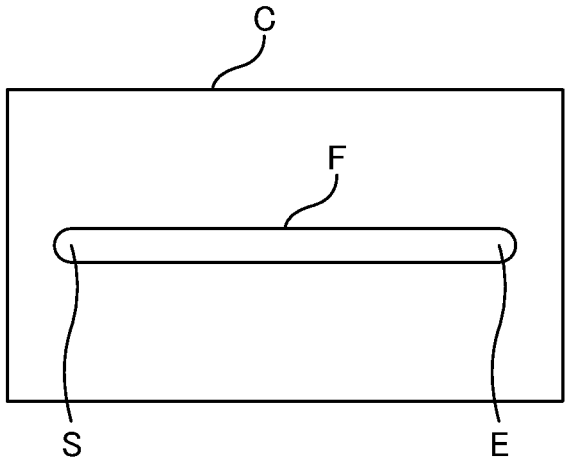
FIG. 4 is a diagram showing a substrate with foil applied by the foil transfer device according to the first preferred embodiment of the present invention.

As a result, for example, in the case of transferring a foil film as shown in FIG. 4, it is possible that a certain area that is intended to be transferred is not transferred at the beginning of the acceleration or just before the stop.

In this preferred embodiment, in order to solve this problem, an example where the controller 15 controls the light emitter so as to allow the light emitter to change the power of the laser beam by PWM control is described. Since the configuration of the foil transfer device 1 is the same as that of the first preferred embodiment, details thereof are not described here.

The controller 15 according to this preferred embodiment produces a laser beam by PWM control. The PWM control is a control method of changing the power of the laser beam by pulse-controlling a duration of applying the electric current while maintaining the peak of the electric current value flowing through the laser emitter 12. By performing the PWM control, the absolute value of the electric current is made constant, so that the laser emitter 12 stably emits the laser beam from the beginning of acceleration.

FIG. 5A is a diagram showing a relationship between the velocity indication value used to determine the velocity at which the irradiator 13 is moved and an electric current value flowing through the laser emitter 12. The controller 15 moves the irradiator 13 by supplying the velocity indication value as shown in FIG. 5A to the driver 14 in time series. With the velocity indication value shown in FIG. 5A, the irradiator 13 gradually accelerates according to the velocity indication value (the acceleration period) and, after reaching a certain velocity, moves at that velocity (the period of travel at the constant velocity). The irradiator 13 then gradually decelerates from the constant velocity (the deceleration period), and finally stops. As in the first preferred embodiment, predetermined values are set beforehand for the velocity at the constant velocity and the power of the laser beam (i.e., the electric current value) during the constant velocity.

The controller 15 changes the power of the laser beam by PWM control according to such velocity indication value. Specifically, the controller 15 supplies to the laser emitter 12 a PWM signal with a predetermined frequency (several kHz to several tens of kHz) with a certain duty ratio.

The duty ratio is determined based on the velocity indication value. According to the velocity indication value, the controller 15 controls the duty ratio of the PWM signal to gradually increase it during acceleration (see FIG. 5A). The gradual increase of the duty ratio leads to gradual increase of the pulse width of the electric current flowing through the laser emitter 12 in a predetermined cycle. In addition, the controller 15 controls the duty ratio of the PWM signal to gradually decrease it during deceleration according to the velocity indication value (see FIG. 5A). The gradual reduction of the duty ratio leads to gradual reduction of the pulse width of the electric current flowing through the laser emitter 12 in a predetermined cycle. In the laser emitter 12, an electric current corresponding to the supplied PWM signal flows and a laser beam is emitted.

In other words, the controller 15 performs control, according to the velocity indication value, to gradually increase the time duration during which the electric current is applied during acceleration and gradually reduce the time duration during which the electric current is applied during deceleration, while maintaining the electric current flowing through the laser emitter 12 to be constant (see, the periods designated as "Acceleration" and "Deceleration" in FIG. 5A). The velocity indication value is kept constant during the period of travel at the constant velocity; therefore, the controller 15 controls the electric current flowing through the laser emitter 12 to be fixed during the period of travel at the constant velocity (see the period designated as "Constant velocity" in FIG. 5A; the duty ratio is not changed).

It should be noted that, during the period of travel at the constant velocity in FIG. 5A, the laser emitter 12 is controlled so that an electric current continuously flows through it. On the other hand, the controller 15 may perform control so that a pulsed electric current flows with a certain duty ratio during the period of travel at the constant velocity as in the case of the acceleration and deceleration (see FIG. 5B).

Figure 7:
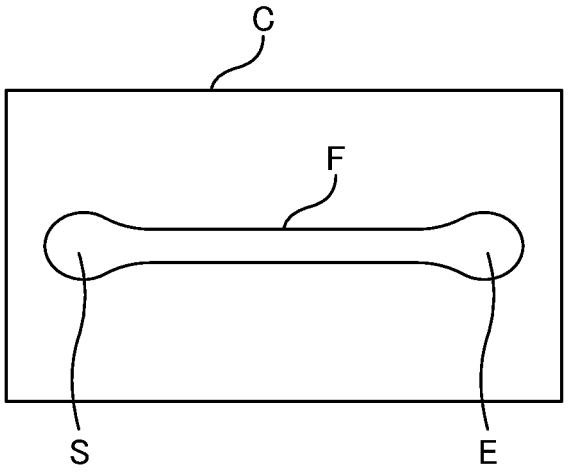
FIG. 7 Prior Art
FIG. 7 is a diagram showing a substrate with foil applied by a foil transfer device according to a conventional art.

As described above, by gradually changing the duty ratio of the PWM signal during acceleration or deceleration of the irradiator 13 according to the velocity, the electric current flowing through the laser emitter 12 per unit time is able to be made constant. That is, the power of the laser beam per unit time given to the foil film F is able to be made constant and the amount of heat transferred to the foil film F is also made constant accordingly. Even during accelerating or decelerating, the transferred foil film F does not suffer from expansion as shown in FIG. 7. The controller 15 of this preferred embodiment is able to change the output of the laser according to the velocity indication value by changing the applied electric current according to the velocity indication value by the PWM control. Therefore, it is possible to reduce uneven transfer during acceleration and deceleration.

Further, by using the PWM control, the laser emitter 12 is capable of emitting laser beams stably even at the time when acceleration of the irradiator 13 begins or at the time immediately before it comes to a stop. Therefore, the irradiation of the laser does not become insufficient at the beginning of the acceleration or just before the stop.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A foil transfer device to transfer a foil film to a substrate into a predetermined shape by scanning with light, the substrate on which the foil film is provided, the foil transfer device comprising:

a light emitter that emits the light;

a driver to cause the scanning to be performed with the light by moving one or both of an irradiator and the substrate relative to each other, the irradiator casting the light emitted by the light emitter; and a controller that controls the light emitter so as to allow the light emitter to change power of the light according to a velocity indication value during at least one of an acceleration period from a time when at least one of the irradiator and the substrate begins to move to a time when a velocity thereof becomes constant and a deceleration period from a time when the velocity is constant to a time when at least one of the irradiator and the substrate stops.

2. The foil transfer device according to claim 1, wherein the controller controls the light emitter so as to allow the light emitter to change the power of the light by analog control.

3. The foil transfer device according to claim 1, wherein the controller controls the light emitter so as to allow the light emitter to change the power of the light by PWM control.

* * * * *